US012123165B1

(12) United States Patent
Fesi et al.

(10) Patent No.: US 12,123,165 B1
(45) Date of Patent: Oct. 22, 2024

(54) METHOD AND APPARATUS FOR EXCAVATING A SOIL CONTAINING MASS

(71) Applicants: Michael A. Fesi, Houma, LA (US); Rohn Rhodes, Jr., Houma, LA (US)

(72) Inventors: Michael A. Fesi, Houma, LA (US); Rohn Rhodes, Jr., Houma, LA (US)

( * ) Notice: Subject to any disclaimer, the term of this patent is extended or adjusted under 35 U.S.C. 154(b) by 176 days.

(21) Appl. No.: 17/574,135

(22) Filed: Jan. 12, 2022

Related U.S. Application Data

(63) Continuation of application No. 16/220,545, filed on Dec. 14, 2018, now Pat. No. 11,255,072.

(60) Provisional application No. 62/599,274, filed on Dec. 15, 2017.

(51) Int. Cl.

| | |
|---|---|
| ***E02F 5/00*** | (2006.01) |
| ***E02F 3/43*** | (2006.01) |
| ***E02F 3/88*** | (2006.01) |
| ***E02F 3/90*** | (2006.01) |

(52) U.S. Cl.
CPC ..... *E02F 5/003* (2013.01); *E02F 3/8825* (2013.01); *E02F 3/905* (2013.01); *E02F 3/435* (2013.01)

(58) Field of Classification Search
CPC . E02F 5/003; E02F 5/107; E02F 5/108; E02F 5/8825; E02F 5/905; E02F 5/435
See application file for complete search history.

(56) References Cited

U.S. PATENT DOCUMENTS 4,280,771 A * 7/1981 Schwing et al. ..... E21D 11/105 405/268
4,659,262 A * 4/1987 van Aalst ..... B65G 53/24 15/340.1
2014/0373399 A1* 12/2014 Lamonte ..... E02F 7/00 37/347

* cited by examiner

*Primary Examiner* — Tara Mayo
(74) *Attorney, Agent, or Firm* — Garvey, Smith & Nehrbass, Patent Attorneys, L.L.C.; Charles C. Garvey, Jr.; Julie Rabalais Chauvin

(57) ABSTRACT

A method and apparatus for digging and removing excavated material from a selected site provides a mobile device having a chassis that is movable or self-propelled. The mobile device has an elongated, preferably articulated boom with a free end portion having a digging implement that can include a digging tool, excavating tool or jetting tool. The boom preferably comprises at least three sections. The boom sections are foldable to a storage position on the chassis wherein one boom section stacks upon or is aligned with another boom section. The vacuum line is supported upon the boom wherein the vacuum line extends between the free end portion of the boom and the chassis. The boom attaches to the chassis at a base that can include a rotary or pivotal connection. The vacuum line supported by the boom extends along the boom and above the earth's surface. A selected material is excavated with the excavating implement (e.g., jetting tool or digging tool). The excavated material is vacuumed with the vacuum line into a collection vessel or tank that can be a part of a wheeled vehicle thus enabling transport to a disposal site. A separate vacuum truck can provide a vacuum to a selected collection tank.

18 Claims, 3 Drawing Sheets

METHOD AND APPARATUS FOR EXCAVATING A SOIL CONTAINING MASS

CROSS-REFERENCE TO RELATED APPLICATIONS

This is a continuation of U.S. patent application Ser. No. 16/220,545, filed 14 Dec. 2018 (now U.S. Pat. No. 11,255,072), which claims priority of U.S. Provisional Patent Application Ser. No. 62/599,274, filed 15 Dec. 2017, each of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the removal or excavation of selected material (e.g., a soil mass, sand, gravel or soil containing mass) from a location that is not easily accessible by equipment such as a backhoe, truck, or large excavator. Even more particularly, the present invention relates to an improved method and apparatus for removing material once excavated with a specially configured vacuum hose and boom arrangement wherein the vacuum hose is elevated with a multi-section boom that forms an arch.

2. General Background of the Invention

During the removal of soil or soil containing material or material under the earth's surface, there is a need to continuously remove the excavated matter. In some cases, excavation uses a jetting tool and vacuum such as is seen in the Lamonte patent, U.S. Pat. No. 8,858,124. The Lamonte '124 patent recovers excavated material via a hose that is fitted to a backhoe. A vacuum extends between the backhoe and a vacuum truck.

One of the problems with removal of excavated material is that access to the excavation site is often very limited. For example, in crowded chemical plants, factories, refineries and the like there can be vessels, piping, machinery, buildings or other structures that prevent the placement of a hose on the earth's surface in between a vacuum source and the excavation site. In some places the ground is soft or otherwise unstable and not able to support a heavy vacuum truck where the excavation needs to occur.

BRIEF SUMMARY OF THE INVENTION

The present invention provides an improved method and apparatus for removing excavated material from a selected site even when access to the site is very limited or restricted.

The present invention provides a method of excavating a mass of soil-containing material using a mobile device having a chassis that is movable or self-propelled. The mobile device has an elongated articulated multiple (e.g., three, four, or five) section boom with a free end portion. Each boom section connects to another boom section at a joint (e.g., pivot). The boom sections include a boom chassis section on said chassis, a boom free end section and one or more middle boom sections in between the chassis boom section and the boom free end section. In general, articulated boom trucks are known such as for pumping concrete (e.g., see U.S. Pat. No. 6,390,504 entitled "Mobile Concrete Truck" and 7,398,981 entitled "Auxiliary Axle System for Concrete Pump Truck"). U.S. Pat. Nos. 6,390,504 and 7,398,981 are each hereby incorporated herein by reference.

The boom free end portion can include a digging implement that can include a first jetting tool. Other jetting tools (e.g. second and third) can be used to speed up excavation. The boom can be foldable to a storage position on the chassis. The boom sections can stack next to each other when in a foldable storage position. During use, the boom sections form an arch or arch shape (e.g., generally semi-circular shape).

The method includes supporting a vacuum line upon the boom wherein the vacuum line extends between the free end portion of the boom and the chassis, the vacuum line is supported by the boom and extends along the boom and above the earth's surface. The vacuum line can be hard pipe with fluid conveying swivel connections at each boom joint or a flexible hose or a combination of hard pipe sections and flexible hose. The vacuum line could be about two to six inches (2"-6") in diameter or between about three to four inches (3"-4") in diameter. The vacuum pipe or hose can thus track the same arch shape as the boom. In this fashion, the vacuum line is able to avoid obstructions on the earth's surface such as vessels, piping, buildings, tanks, vehicles, electrical equipment or the like.

The material (e.g., soil, sand, gravel, a mixture, soil-containing material) can be excavated with the digging implement such as a jetting tool or tools. The method can include breaking up soil-containing material near the digging implement with a second (or second and third or more) jetting tool that is not a part of the digging implement.

The excavated soil-containing material is removed with the vacuum line.

In one embodiment, the boom comprises multiple boom sections connected end to end at boom joints (e.g., pivotal connections) and said boom has an apex.

In one embodiment, each boom section is connected to another boom section at a boom joint and one of the boom joints defines a boom apex.

In one embodiment, the vacuum hose or pipe sections extend to the boom apex.

In one embodiment, the boom connects to the chassis at a rotary connection.

In one embodiment, the mobile device supports a vacuum source that connects to the vacuum line.

In one embodiment, the boom is a multiple section boom that includes one boom section mounted to the chassis, and a second boom section having said free end portion and a third (or third and fourth) boom section in between the first and second boom sections.

In one embodiment, the vacuum line extends from the chassis to the digging implement and tracks, preferably closely, along the articulated boom.

In one embodiment, the articulating boom has an unfolded operating position that tracks an arch shape and wherein the vacuum line is attached to the articulating boom and also tracks the arch shape.

The apparatus of the present invention is an excavation system having a mobile device having a chassis that is movable or self-propelled.

The mobile device has an outermost elongated articulated multiple section boom that is foldable to a storage position on the chassis. The boom has a free end portion.

A vacuum line is supported upon the boom. The vacuum line extends between the free end portion of the boom and the device chassis. The vacuum line is supported by the boom and extends along the boom and above the earth's surface. During use, the vacuum line thus tracks an inverted U shape or arch shape. A vacuum source is in communication with the vacuum line for enabling vacuuming of soil-containing material that is excavated with the digging implement. The vacuum line enables the transmission of soil and excavated material to a collection vessel via the vacuum line.

In one embodiment, the articulating boom comprises multiple boom sections connected together end to end, the boom having an apex.

In one embodiment, the articulating boom comprises multiple boom (e.g., three, four or five) sections connected together end to end, each boom section connected to another boom section at a boom joint, one of the boom joints defining the boom apex.

In one embodiment, the vacuum line comprises multiple sections of pipe. Each section of pipe connects to another section of pipe with a fluid-tight swivel joint. The vacuum line swivel joints can be mounted at or next to a boom joint.

In one embodiment, the vacuum line extends to the boom apex.

In one embodiment, the vacuum line has one end portion that connects to the digging implement, another end portion extending to the chassis and a middle section connected to the articulating boom at multiple positions along the articulating boom.

In one embodiment, the vacuum line closely conforms to the articulating boom along the length of the boom.

In one embodiment, the articulating boom is pivotally connected to the chassis.

In one embodiment, the collection vessel is on the chassis.

In one embodiment, the collection vessel is on a second mobile device. In one embodiment, the articulating boom has at least three boom sections.

In one embodiment, the articulating boom has at least four boom sections.

In one embodiment, the articulating boom has at least five boom sections.

In one embodiment, the digging implement includes one or more jetting nozzles.

In one embodiment, the boom sections can extend from the chassis a distance of between about 5 and 200 feet. Preferably, the end of the boom distal from the boom truck is at least 30 feet from the boom truck: more preferably, the end of the boom distal from the boom truck is at least 50 feet from the boom truck; even more preferably, the end of the boom distal from the boom truck is at least 100 feet from the boom truck; more preferably still, the end of the boom distal from the boom truck is at least 150 feet from the boom truck; and even more preferably, the end of the boom distal from the boom truck is at least 200 feet from the boom truck.

In one embodiment, the second mobile device is a truck supporting a collection vessel or tank.

In one embodiment, there are at least two collection vessels so that while one vessel or tank is being filled, the other vessel or tank can be transported to a selected disposal site.

In one embodiment, one or more of the collection vessels is a vehicle, such as a truck.

In one embodiment, first and second jetting tools are provided for breaking up the soil or material to be excavated, one jetting tool supported by the boom and another jetting tool not supported by the boom. There can be for example a third jetting tool as well.

In one embodiment, the vacuum line includes multiple pipes or separate pipe sections, each pipe section connected to another pipe section next to a boom joint.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
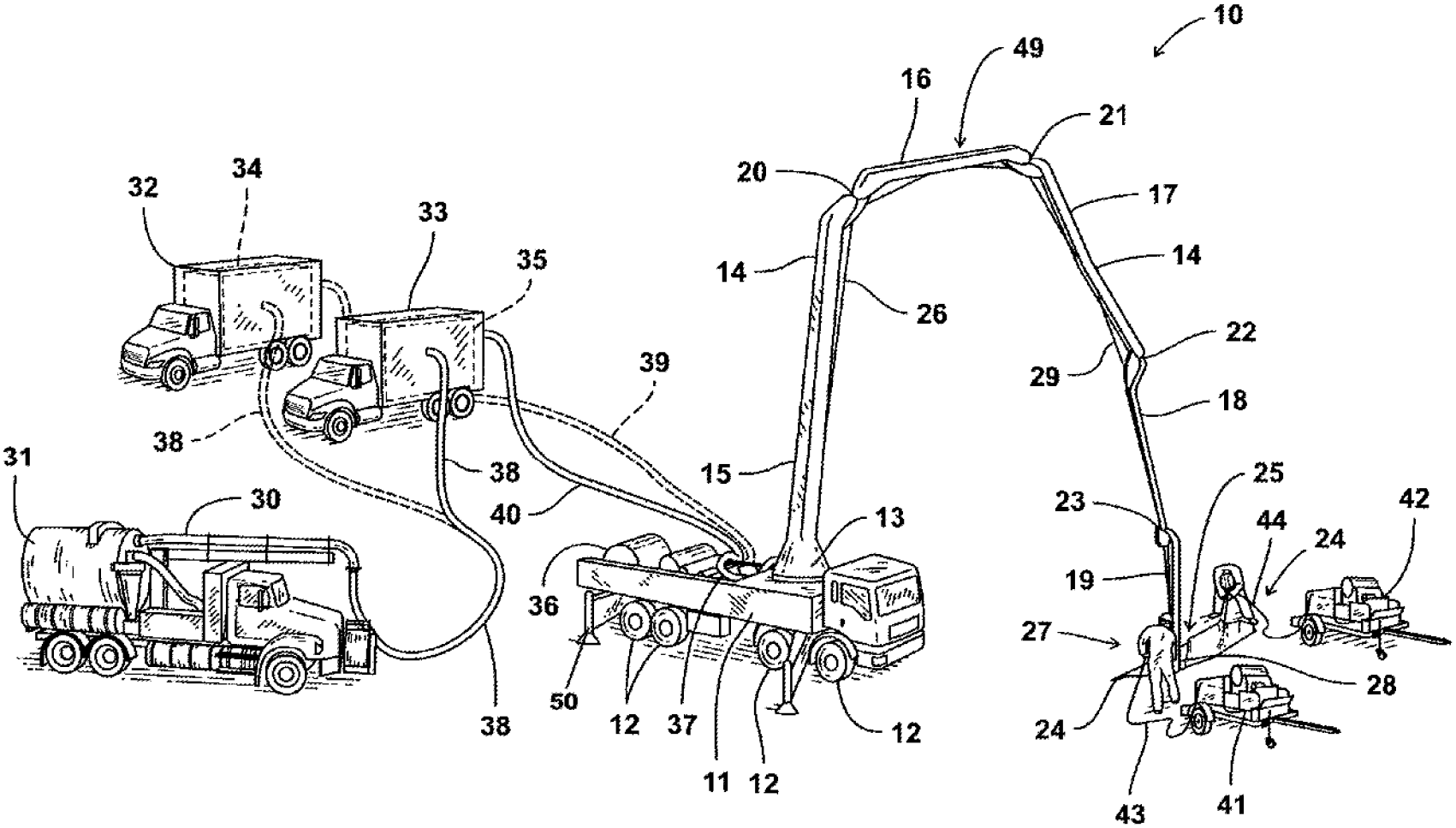
FIG. 1 is a perspective view of a preferred embodiment of the apparatus of the present invention.
Figure 2:
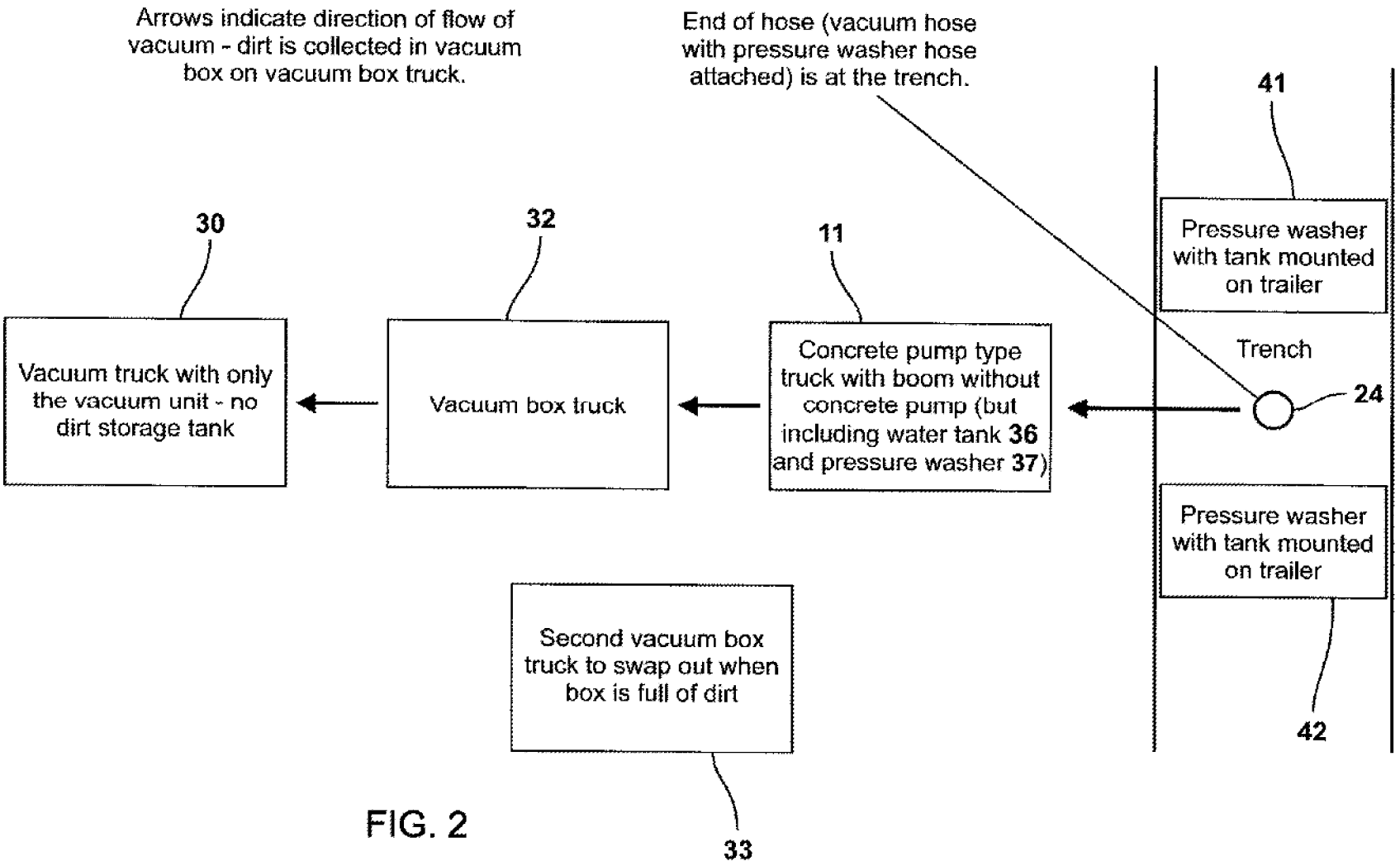
FIG. 2 is a schematic diagram of the method and apparatus of the present invention.
Figure 3:
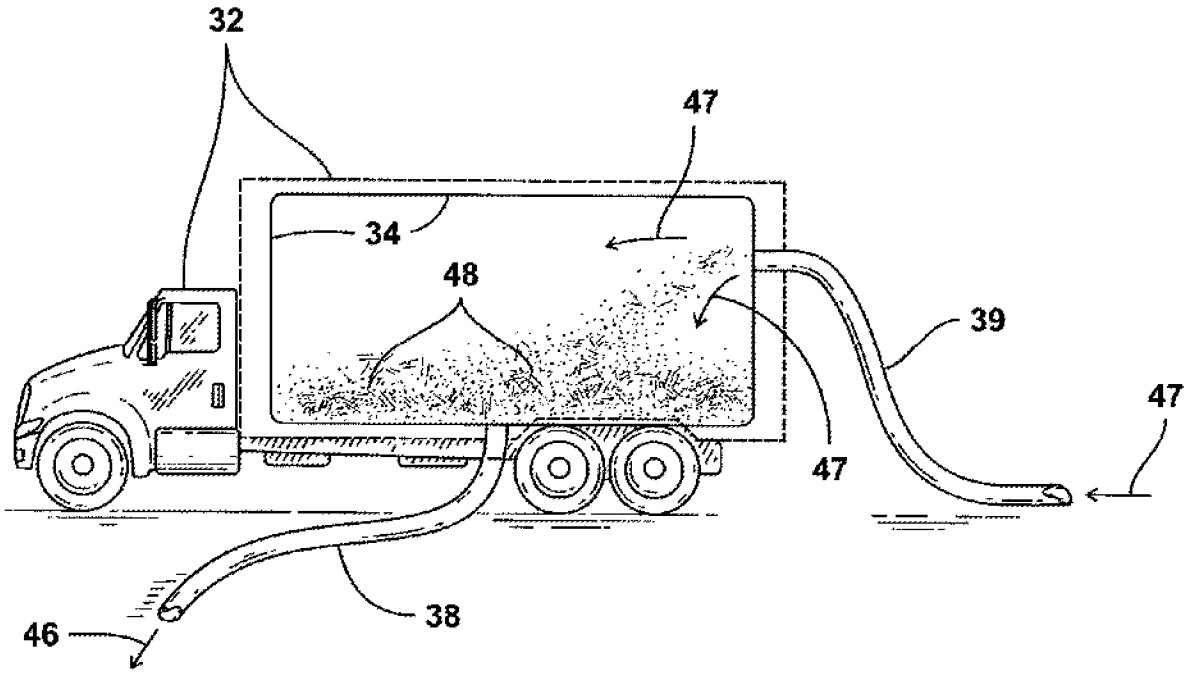
FIG. 3 is a fragmentary view of a preferred embodiment of the apparatus of the present invention.

FIGS. 1-3 show a preferred embodiment of the apparatus of the present invention designated generally by the numeral 10. Excavating apparatus 10 provides a chassis 11 that supports articulating boom 14. Chassis 11 can be wheeled, providing a plurality of wheels 12 for supporting the weight of the boom 14. Chassis 11 can also have outriggers 50 to help support the weight of the boom 14, water tank 36, and pressure washer pump and engine combination 37.

Articulating boom 14 is preferably a multi-section arch shaped boom that is mounted to the chassis 11 at base 13 which can include a pivotal or rotary connection. In a preferred embodiment, the articulating boom 14 can provide three, four or five boom sections 15, 16, 17, 18, 19 that form an arch as seen in FIG. 1. The middle boom sections 16, 17, 18 are thus elevated and spaced away from the truck/chassis. The boom section 15 is a chassis boom section. The boom section 19 is a boom free end section. Each boom section 15-19 connects to another boom section with a boom joint. For example, the boom section 15 connects to the boom section 16 at boom joint 20. Similarly, there are boom joints at 21, 22 and 23. The five boom sections 15-19 connect end to end as shown with the boom apex 49 typically being at joint 20 or 21 (but it could be in between). These five boom sections can total about 60-120 feet long (or longer), for example. Apex 49 can be between about 30 and 100 feet high, for example.

The apparatus 10 of the present invention is used to excavate material from a selected site such as the trench or excavation 24 shown in FIG. 1. Articulating boom 14 provides a boom free end portion 25 that can be part of the boom section 19 that is farthest away from chassis 11. Boom free end section 19 and boom free end portion 25 can support a digging implement 27 (e.g., jetting pipe or lance) which can include a jetting nozzle or nozzles 28 that receive water flow via jetting line 29 from water tank 36 and pressure washer pump and engine 37. For example, a four to six-foot (4'-6') jetting pipe or lance can be supported at the end of the boom on boom free end section 19. A separate power jetting unit (e.g., engine and water pump) would supply high pressure fluid to the jetting pipe via a high-pressure hose. The jetting pipe could be fitted with a jetting nozzle at its lower end. Alternatively, a jetting line 29 could track along boom 14 and be supported by boom 14. In such a case, an engine and pump could be mounted on chassis 11. Vacuum line 26 preferably extends between digging implement 27 and chassis 11. A vacuum source 31 can be part of a separate vacuum truck 30 which is used to pull a vacuum on line 38. Such vacuum trucks 30 are commercially available, such as sold under the name/mark "Rival Hydrovac".

One or more valves on chassis 11 can be used to direct cuttings from trench or excavation 24 to a selected collection truck 32 or 33 via line 26 and lines 39, 40. Each truck 32, 33 provides a collection tank. The first collection truck 32 provides a collection tank 34. The second collection truck 33 provides a collection tank 35. Vacuum piping is provided that enables flow of cuttings or excavated material to travel via vacuum line 26 to a selected collection tank 34 or 35 via a vacuum line 39 or 40. Vacuum lines 39, 40 are provided that extend between chassis 11 and collection trucks 32, 33 respectively. Vacuum line 38 can be selectively attached to either collection truck 32 or collection truck 33. In FIG. 3, arrow 46 schematically illustrates a vacuum pulled on tank 34 of truck 32 with line 38 that connects to vacuum truck 30. Arrows 47 schematically represent flow of cuttings or excavated material 48 to tank 34 via vacuum line 39.

As part of the method of the present invention, pressure washers 41, 42 can be provided in addition to the pressure washing digging implement 27. Each of the pressure washers 41, 42 provides a jetting wand or tool with a nozzle. Pressure washer 41 provides jetting tool wand with nozzle 43 while a jetting wand tool with a nozzle 44 is provided with pressure washer 42. Such pressure washers 41, 42 are commercially available and sold under the marks Pressure Pro, Yamaha®, Simpson, Generac®, Hot2Go, as examples (e.g., see www.pressurewashersdirect.com). Pressure washers are available in a wide range of pressure ratings (e.g., 1000-7000 psi). Some generate steam and/or hot water.

The inside diameter of vacuum hoses 26, 38, 39, 40 can be about 2-10 inches. The length of vacuum hose 26 can be about 65-125 feet. Hoses 26, 38, 39, 40 are commercially available. The suction of the vacuum can be about 0-948 mbar, using for example a vacuum source commercially available from Super Products LLC (https://www.superproductsllc.com/). The pressure washers 41, 42 can be, for example, 3,500-7,000 PSI washers with 5-25 HP pumps. Pressure washing digging implement 27 can be connected to a pressure washer pump/engine (or a pressure washer) 37 on truck chassis 11 similar to pressure washers 41, 42. Pressure washer 37 can be, for example, a 3,500-7,000 PSI washer with a 5-25 HP engines (e.g., Honda, Kawasaki, Briggs and Stratton) powering a water pump. The pressure washer hoses can be about 0.5-1 inch in diameter and able to withstand 3,500-7,000 PSI of pressure. Such hoses are commercially available. Truck chassis 11 is preferably of a size that it can be transported without escort; typically, in most states that is not larger than 45 feet long by 8.5 feet wide.

The boom 14 can be operated by an operator in the cab of the truck 11 or elsewhere with a remote control.

Additional digging tools can be attached to the end of the vacuum line distal from the boom truck—there are such tools commercially available from Super Products LLC (https://www.superproductsllc.com/).

The following is a list of parts and materials suitable for use in the present invention:

PARTS LIST:

| PART NUMBER | DESCRIPTION |
|---|---|
| 10 | excavating apparatus |
| 11 | chassis/truck |
| 12 | wheel |
| 13 | base/rotary connection/pivoting connection |
| 14 | articulating boom |
| 15 | boom section/chassis boom section |
| 16 | boom section |
| 17 | boom section |
| 18 | boom section |
| 19 | boom section/boom free end section |
| 20 | boom joint |
| 21 | boom joint |
| 22 | boom joint |
| 23 | boom joint |
| 24 | trench, excavation |
| 25 | boom free end portion |
| 26 | vacuum line/vacuum hose |
| 27 | digging implement |
| 28 | jetting nozzle |
| 29 | jetting line |
| 30 | vacuum truck |
| 31 | vacuum source |
| 32 | first collection truck |
| 33 | second collection truck |
| 34 | collection tank |
| 35 | collection tank |
| 36 | water tank |
| 37 | pressure washer pump/engine |
| 38 | vacuum line/vacuum hose |
| 39 | vacuum line/vacuum hose |
| 40 | vacuum line/vacuum hose |
| 41 | pressure washer |
| 42 | pressure washer |
| 43 | jetting wand/tool with nozzle |
| 44 | jetting wand/tool with nozzle |
| 46 | arrow |
| 47 | arrow |
| 48 | excavated material |
| 49 | apex |
| 50 | outrigger |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of excavating a mass of selected material, comprising the steps of:

a) providing a primary mobile device having a primary chassis that is movable or self-propelled;

b) mounting on the primary mobile device an elongated articulated boom with a boom lower end section mounted on said primary chassis and a boom free end section, said boom comprising at least three sections and wherein said sections are foldable to a storage position on said primary chassis, wherein in said storage position, one boom section stacks next to another boom section;

c) wherein the boom sections include said boom lower end section, said boom free end section and one or more middle boom sections in between the said boom lower end section and said boom free end section;

d) wherein during use the boom sections form an arch;

e) supporting a primary vacuum line upon said boom wherein the primary vacuum line extends between said free end section and the primary chassis, the primary vacuum line supported by the boom and extending along the boom and above the earth's surface;

f) excavating soil containing material with one or more digging implements at a selected location near the primary chassis and boom;

g) vacuuming the excavated soil containing material of step "f" with the primary vacuum line, wherein the excavated soil containing material travels via the primary vacuum line to the primary chassis and vacuum source;

h) transferring the vacuumed soil containing material of step "g" to one or more separate collection vessels via one or more secondary flow lines; and i) wherein each said separate collection vessel is able to travel to or from the primary mobile device as when disposing of excavated soil containing material of step "g".

2. The method of excavating a mass of material of claim 1 further comprising breaking up soil-containing material near the boom free end with a digging implement that is supported by the boom.

3. The method of excavating a mass of material containing material of claim 1 wherein the boom comprises at least four boom sections connected end to end.

4. The method of excavating a mass of material containing material of claim 1 wherein each boom section is connected to another boom section at a boom joint and wherein one of said boom joints defines a boom apex.

5. The method of excavating a mass of material containing material of claim 4 wherein said vacuum line extends to the boom apex.

6. The method of excavating a mass of material of claim 1 wherein the boom connects to the primary chassis at a rotary connection.

7. The method of excavating a mass of material of claim 1 wherein the mobile device supports a vacuum source that connects to the primary vacuum line.

8. The method of excavating a mass of material of claim 1 wherein the primary vacuum line is attached to the articulated boom and also tracks an arch shape.

9. The method of claim 1 wherein one or more of the collection vessels is a vehicle.

10. An excavation system comprising:

a) a primary mobile device having a chassis that is movable or self-propelled;

b) the primary mobile device having an elongated articulated boom that includes a lower chassis boom section and at least three boom sections connected end to end at boom joints;

c) wherein the boom sections include said boom lower chassis section mounted on said chassis, a boom free end section and one or more middle boom sections in between the lower chassis boom section and the boom free end section;

d) wherein during use the boom sections form an arch;

e) wherein said boom is foldable to a storage position on said primary mobile device chassis, said boom having a free end portion and a base end portion at said base;

f) a digging implement for excavating a selected material to be removed;

g) a primary vacuum line supported upon said boom wherein the primary vacuum line extends between the free end portion of the boom and the lower end portion, the primary vacuum line supported by the boom and extending along the boom and above the earth's surface;

h) a vacuum source on said chassis and in communication with the primary vacuum line for enabling a vacuuming of excavated material that is excavated with the digging implement;

i) one or more secondary vacuum lines;

j) one or more separate mobile collection vessels;

k) wherein each secondary vacuum line enables a transmission of said excavated material to a said separate collection vessel via said secondary vacuum line; and l) wherein said one or more separate collection vessels are mobile and able to travel independently of the primary mobile device.

11. The excavation system of claim 10 wherein the articulating boom comprises multiple boom sections connected together end to end, said boom having an apex.

12. The excavation system of claim 11 wherein the articulating boom comprises multiple boom sections connected together end to end, each boom section connected to another boom section at a boom joint, one of said boom joints defining said apex.

13. The excavation system of claim 11 wherein the vacuum line extends to said apex.

14. The excavation system of claim 10 wherein the vacuum line has one end portion that connects to said digging implement, another end portion at said chassis and a middle section connected to the articulating boom at multiple positions along said articulating boom.

15. The excavation system of claim 10, wherein the boom has an end, and the end of the boom is extendable between about 5 and 200 feet from the chassis.

16. The excavation system of claim 10, wherein the boom has an end, and the end of the boom is extendable at least 30 feet from the chassis.

17. A job site excavation system comprising:

a) a primary mobile device having a chassis that is movable or self-propelled;

b) the primary mobile device having a boom that includes a lower end portion proximal to the mobile device chassis and a boom free end portion distal from the mobile device when in use;

c) a digging implement for excavating a selected material to be removed from the job site;

d) a primary vacuum line supported by said boom wherein the primary vacuum line extends between the boom free end portion and the proximal boom lower end portion, the primary vacuum line extending along the boom and above the earth's surface;

e) said primary mobile device having a vacuum source in communication with the primary vacuum line for enabling a vacuuming of material that is excavated with the digging implement;

f) one or more secondary vacuum lines;

g) one or more separate secondary mobile devices, each having a collection vessel;

h) said one or more secondary vacuum lines enabling a transmission of the said material excavated to said secondary mobile device collection vessel via a secondary vacuum line; and i) wherein each said secondary mobile device is mobile so that it can travel to or from the job site independently of said primary mobile device.

18. The excavation system of claim 17 wherein the collection vessel is on said chassis.

* * * * *